US005318174A

United States Patent [19]

Zoroufy

[11] Patent Number: 5,318,174

[45] Date of Patent: Jun. 7, 1994

[54] TEXTILE HANGER

[76] Inventor: Aboolhassan Zoroufy, 410 D'Onofrio Dr., Madison, Wis. 53719

[21] Appl. No.: 972,989

[22] Filed: Nov. 10, 1992

[51] Int. Cl.[5] ..... A47F 5/00

[52] U.S. Cl. ..... 211/45; 211/89; 211/105.1

[58] Field of Search ..... 211/45, 113, 89, 119, 211/105.1; 223/91, 93, 96

[56] References Cited

U.S. PATENT DOCUMENTS

| | | | |
|---|---|---|---|
| 551,124 | 12/1995 | Krah . | |
| 597,551 | 1/1989 | Atkins . | |
| 606,442 | 6/1989 | Bullis . | |
| 1,884,414 | 10/1932 | Vroom . | |
| 2,067,833 | 1/1937 | Edison | 211/89 |
| 2,589,564 | 3/1952 | Moore | 211/89 |
| 2,622,300 | 12/1952 | Marziani . | |
| 2,626,713 | 1/1953 | Peacock | 211/89 |
| 2,946,454 | 7/1960 | Asher | 211/45 |
| 2,987,193 | 6/1961 | Pajor | 211/89 |
| 3,194,405 | 7/1965 | Hawie | 211/89 |
| 3,195,733 | 7/1965 | Best | 211/45 |
| 4,629,075 | 12/1986 | Hutten . | |
| 4,830,322 | 5/1989 | Gary . | |

*Primary Examiner*—Robert W. Gibson, Jr.
*Attorney, Agent, or Firm*—Stroud, Stroud, Willink, Thompson & Howard

[57] ABSTRACT

A textile or the like hanger having a plurality of releasably fastenable toothed suspender clips, a support rod, and support brackets. Each suspender clip has a cradle hook portion for hanging the clips on the rod.

9 Claims, 3 Drawing Sheets

TEXTILE HANGER

TECHNICAL FIELD

This invention relates generally to hangers for sheet material, and in particular, to clamping devices for suspending and display sheet material on a vertical surface. The invention is particularly well-suited for suspending of rugs or other textiles as wall hangings.

BACKGROUND OF THE INVENTION

Display of rugs and carpets, particularly oriental and Persian rugs, on walls or the like has become popular as such textiles are increasingly recognized not only for their utilitarian function but also as pieces of art. These rugs and carpets tend to be large pieces, often measuring, 5 ft. by 7 ft. or larger, and consequently have considerable weight.

Curtain rods and holders have been long known for suspending fabrics and cloth to cover windows and the like. See, for example, U.S. Pat. No. 1,884,414 issued to Vroom; U.S. Pat. No. 551,124 issued to Krah; U.S. Pat. No. 606,442 issued to Bullis; and U.S. Pat. No. 597,551 issued to Atkins. Generally, curtain or drapery material is considerably lighter in weight than carpets and rugs, and generally, holes or specially constructed pleats are made in the material so that rings or hooks can be inserted and then attached to rods.

Other clamping or holding devices for supporting objects such as flexible sheets, charts, blueprints, placards and the like are also known. See, for example, U.S. Pat. No. 2,622,300 issued to Marziani (hanger for blueprints); U.S. Pat. No. 4,629,075 issued to Hutten (mounting strip for flexible sheet material); and U.S. Pat. No. 4,830,322 issued to Gary (chart holder). Such suspending devices are geared to hanging objects that are substantially light in weight and are not suitable for hanging a rug or carpet.

The hanging of rugs and carpets is a formidable task because of their considerable weight and because as art pieces, owners have generally not relished making holes in the carpets in order to hang them. Often times, to avoid making holes in the carpets, loops of material are attached to an edge and then slid onto a rod secured to a wall at the appropriate height. Such additions, of course, tend to detract from the carpet piece. Moreover, because of the substantial weight of the carpets, problems have arisen with the rod for holding the carpet. The rod must have substantial rigidity to hold the rug without bending with its weight.

Thus, a problem, largely unattended in the art, is the lack of a simple, inexpensive way to hang rugs and carpets without damaging the pieces and in which the rugs and carpets are firmly yet releasably gripped.

SUMMARY OF THE INVENTION

The present invention provides a textile hanger that permits simple, releasable hanging of rugs or carpets without an alleviation of the rug or carpet piece. The hanger is particularly useful for displaying heavy textile materials on vertical surfaces such as walls. The hanger is simple to install and can be constructed in a variety of sizes to accommodate a wide range of rug and carpet sizes.

The foregoing and other advantages of the present invention are realized in one aspect thereof in a textile hanger that includes (i) a rod, (ii) a plurality of support brackets fastenable to a vertical display surface for holding the rod horizontally, and (iii) a plurality of toothed suspender clips slidably suspendable from the rod for securing the textile articles to the rod. Each of the suspender clips includes a gripper and a hook. The hook is slidably hangable about the rod permitting the clips to be disposed at any position along the rod. Thus, in use, the clips simultaneously hold a textile or the like material in a vertical plane.

The gripper includes (i) a pair of opposed gripper plates, one of these plates being mounted for movement and engagement with the other plate to grip a material placed between the plates, and (ii) an actuator cover pivotally mounted on one plate for urging and engaging one plate toward and with the other plate. The hook includes a cradle-like portion and a neck portion, and wherein the neck portion is press-fittedly connected in the gripper.

In another aspect, the invention is a method for displaying a textile item comprising the steps of: (i) securing a horizontal rod to a vertical display surface, (ii) slidably suspending a plurality of manually-actuated, toothed suspender clips from the rod by a cradle hook of the suspender clip, (iii) gripping one edge of a textile item into the suspender clips, and (iv) manually actuating the suspender clips to secure the textile item to the rod.

The invention also provides a carpet display kit that includes a rod, two or more support brackets for holding the rod, a plurality of toothed suspender clips having a cradle hook portion for hanging the clips on the rod and fasteners for securing the support brackets to a vertical surface.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWINGS

The preferred exemplary embodiment of the present invention will hereinafter be described in conjunction with the appended drawing wherein like designations refer to elements throughout and in which.

DETAILED DESCRIPTION

The present invention relates broadly to clamping or supporting devices for vertically suspending or displaying objects such as textiles. However, the present invention is most particularly adapted for use in hanging rugs, carpets or other large, heavy textile materials. Accordingly, the present invention will now be described in detail with respect to such endeavors; however, those skilled in the art will appreciate that such a description of the invention is meant to be exemplary only and should not be view as limitative on the full scope thereof.

The present invention provides a textile hanger that is simple in construction, is easily installed, and is rugged enough to hold heavy display pieces without requiring any destruction or invasive operations on the display piece. These attributes are achieved through a novel combination of physical features.

As used herein, the term "tongue-and-groove" is meant to refer to a joint wherein a tongue on the edge of one piece fits into a matching groove or aperture on another piece. The term "cradle" or "cradle-like," e.g., a cradle hook, is meant to refer to a frame or structure or portion thereof whose appearance, shape or outline resembles that of an inverted cradle.

Figure 1:
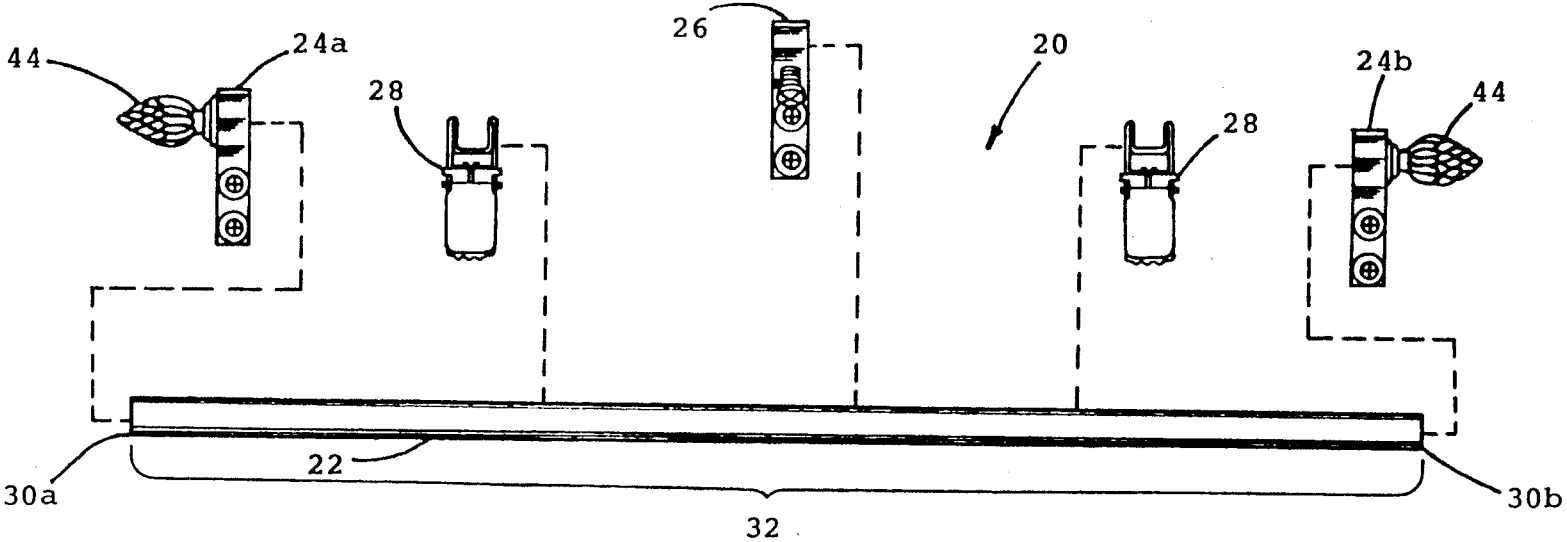
FIG. 1 is an exploded view of a hanger in accordance with the present invention.

Reference is initially made to FIG. 1 depicting a hanger in accordance with the present invention and generally designated with reference numeral 20. The hanger 20 includes a support bar or rod 22, a pair of end support brackets 24*a* and 24*b* for holding rod 22 horizontally to a vertical surface, one or more support brackets 26 that support rod 22 at positions intermediate to end brackets 24, and two or more suspender clips 28 for gripping a material, e.g., a rug or carpet, to be suspended.

Rod 22 is suitably a solid cylindrical bar, although other configurations, such as rectangular, are equally suitable. Rod 22 has ends 30*a* and 30*b* and a length 32. Rod 22 in one embodiment is suitably constructed of metal, preferably brass or a similar metal having the rigidity of brass, i.e., a rod capable of suspending an object without significant flexure. The diameter of rod 22 is adaptable to the particular weight of textile to be suspended, but is typically about 0.5 in. (1.25 cm). The length of rod 22 can vary according to the width or length of the piece to be suspended.

Figure 3:
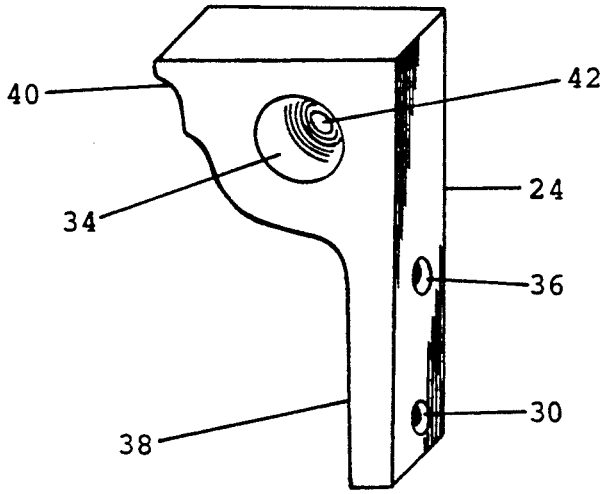
FIG. 3 is a perspective view of an end bracket for the hanger of FIGS. 1 and 2.

End brackets 24 are also suitably constructed of metal. As seen in FIG. 3, each end brackets 24 has a recess 34 for receiving an end of rod 22, and has one or more apertures 36 for use in securing the brackets to a wall or the like. End brackets 24 have opposite symmetry such that the recess 34*a* of bracket 24*a* is disposed on the opposite side from recess 34*b* of end bracket 24*b*. Apertures 36 are suitably sized to receive a wall fastener such as a screw or nail (not shown). In the illustrated embodiment, end bracket 24 is a right-angled piece having a bottom leg portion 38 into which apertures 36 are formed and a top portion 40 into which recess 34 is formed.

Optionally, as best seen in FIG. 1 and 3, the recess 34 of end brackets 24 has an aperture 42 suitably for receiving a fastener such as a screw (not shown). The screw is fastenable through aperture 42 to a knob 44.

Figure 4:
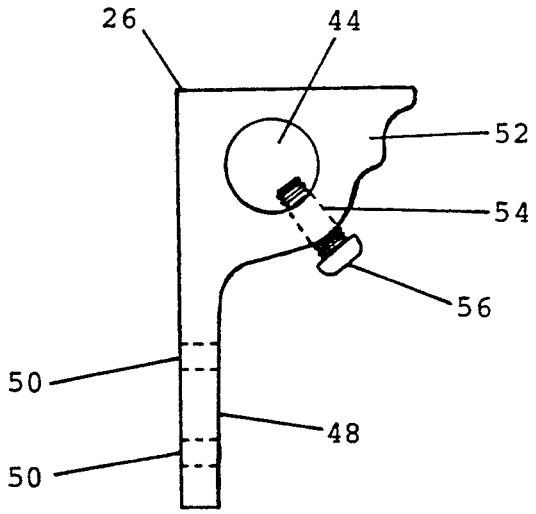
FIG. 4 is a side view of an intermediate support bracket.

Brackets 26 are positioned along rod 22 to support the rod 22. As seen in FIG. 4, each support bracket 26 has a rod aperture 44 to receive rod 22 therethrough. Support brackets 26 are suitably substantially right-angled members similar to end brackets 24. In the illustrated embodiment, support bracket 26 has a bottom leg portion 48 having one or more apertures 50 therethrough and a top portion 52 in which aperture 44 is formed. Apertures 50 are suitably sized to receive fasteners such as screws or nails (not shown) to fasten bracket 26 to a wall. Top portion 52 also includes a second aperture 54 connecting to aperture 44. Aperture 54 is suitably threaded and sized to receive a screw or the like 56 so that when screw 56 is screwed into aperture 54 it will contact and exert pressure on rod 22 inserted through aperture 44, holding rod 22 firmly.

Figure 5:
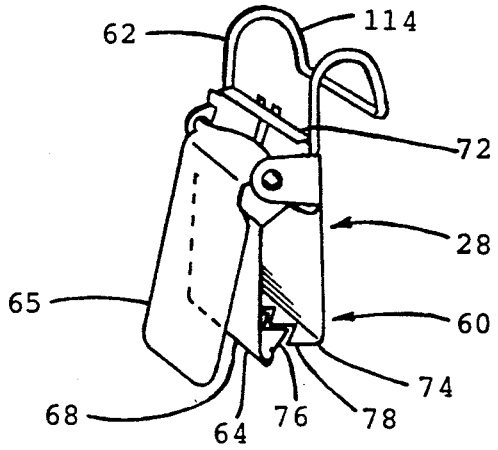
FIG. 5 is a perspective view of a suspender clip of the hanger of FIGS. 1 and 2.
Figure 6:
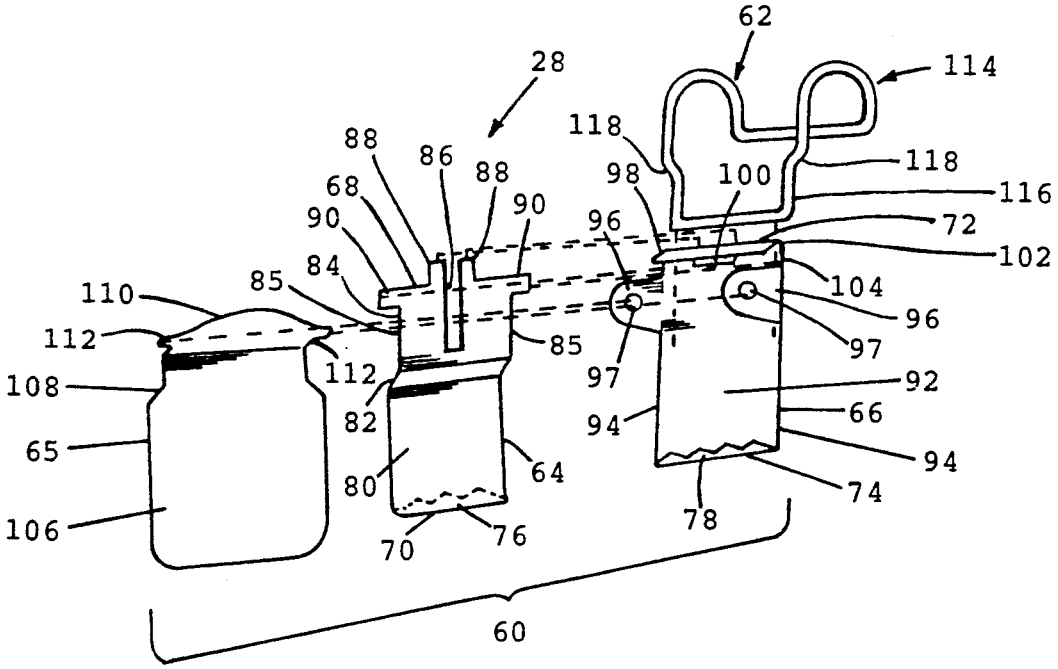
FIG. 6 is an exploded view of the suspender clip of FIG. 5.

Referring now to FIGS. 5 and 6, each suspender clip 28 includes a gripper 60 and a cradle hook 62. Each gripper 60 includes a front gripper plate 64, a back gripper plate 66 and an actuator cover 65. Front plate 64 has a top end 68 and a bottom end 70; back plate 66 has a top end 72 and a bottom end 74. Bottom end 68 of front plate 64 has a set of teeth members 76 extending perpendicularly from bottom end 68, and bottom end 74 of back plate 66 has a set of teeth members 78 extending perpendicularly from bottom 74. Teeth 76 of plate 64 are opposed and complementary to teeth 78 of plate 66. Teeth 76 are mounted, as described hereinafter, for movement and complementary interlocking with teeth 78 to grip a material placed between the front and back gripper plates, 64 and 66.

Front plate 64 also includes a bottom portion 80, a middle biased portion 82, and a top portion 84 having opposite sides 85. Top portion 84 includes a top centrally disposed elongate groove 86 and a first pair of projecting extensions or fingers 88 adjacent groove 86 outwardly extending from top end 68 in parallel fashion. Top portion 84 also has a second pair of projecting extensions or fingers 90*a* and 90*b*; fingers 90 extend oppositely from each other, one from each of sides 85 of top portion 84 proximate the top end 68.

Back plate 66 also includes a back panel portion 92, opposed sides 94, a pair of fin portions 96 depending in parallel direction from sides 94 proximate top end 72, and a top panel portion 98 depending substantially perpendicularly from back panel portion 92. Each fin portion 96 has an aperture 97. Back panel 66 also includes an aperture 100 centrally disposed at the bight 102 of top panel portion 98 and back panel portion 92. Top panel portion 98 and fins 96 form a pair of oppositely disposed side grooves 104.

Actuator cover 65 includes an elongate plate portion 106, a neck portion 108, an angled top plate portion 110, and a pair of opposite extending projections or fingers 112. Actuator cover 65 is pivotally mounted at fingers 112 to back plate 66 in apertures 97 of fins 96.

In assembly of gripper 60, front plate 64 is joined to back plate 66 in tongue-and-groove fashion such that grooves 104 of back plate 66 receive fingers 86 of front plate 64 and aperture 100 receives fingers 90 of front plate 64. In use, to close gripper 60 actuator cover 65 is lowered, pivotally engaging front plate 64 with top panel portion 98 pushing middle portion 82 and top portion 84 of front plate 64 until teeth 76 and 78 complimentarily engage each other. ,To open gripper 60, actuator cover 65 is raised, releasing top panel portion 98 from plate 64 and permitting plates 64 and 66 to be spaced apart.

Cradle hook 62 is a wire form having a cradle-like portion 114 at one end and a neck portion 116 at the other end. Neck portion 116 includes a shoulder portion 118. Neck portion 120 is press-fitted into back plate 66 with shoulder portion 118 received by grooves 104 and neck portion 116 fitted between fins 96. Cradle-like portion 114 of cradle hook 62 is contoured to rod 22 and slidably rests thereon.

Figure 2:
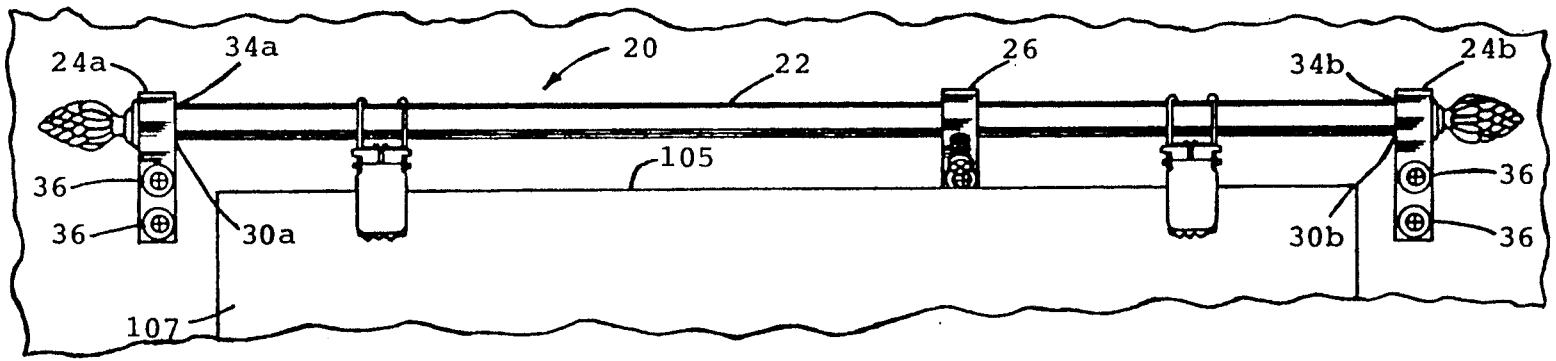
FIG. 2 is a side view of an assembled hanger in accordance with the present invention.

In use, an end bracket 24, e.g., end bracket 24*a*, is secured to a display surface by suitable fasteners such as screws received into apertures 36 in such a manner that where rod 22 is placed in recesses 34, rod 22 is substantially horizontal. Rod 22 is then inserted into recess 34*a* and positioned horizontally to mark the appropriate position for end bracket 24*b*. Rod 22 is temporarily removed from recess 34*a* and end bracket 24*b* is secured to the display surface by fasteners through aperture 36 so that bracket 24*b* can rotate about the fastener. Rod 22 is again placed in recess 34*a* and bracket 24*b* is rotated so that recess 34*b* receives rod 22. Bracket 24*b* is then firmly secured to the display surface. Two or more grippers 60 are then engaged to grip the rug or carpet to be displayed. As seen in FIG. 2, an edge 105 of a rug or carpet 107 is inserted between gripper plates 64 and 66 with actuator cover 65 raised; actuator 65 is then lowered or closed, and the rug or carpet is hung by placing cradle hooks 116 of grippers 60 at appropriate positions onto rod 22.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

I claim:

1. A textile or the like hanger, comprising:

at least two releasably fastenable suspender clips, an elongate support rod, and at least two support brackets for fixedly attaching said rod to and spaced apart from and parallel to a vertical surface or wall;

each of said clips slidably suspended from said elongate support rod so that, in use, said clips simultaneously hold a textile or the like material in a vertical plane and parallel to said vertical surface or said wall;

each of said clips including a gripper and a hook, said hook having a first end having a cradle-like portion contoured to said rod and slidably hangable about said rod permitting said clips to be disposed at any position along said rod, said hook further having a second end having a neck portion opposite said first end, with said neck portion operatively secured to said gripper.

2. The hanger of claim 1, wherein said gripper includes (i) a pair of opposed gripper plates, one of said plates being mounted for movement and engagement with said other plate to grip a material placed between said plates, and (ii) an actuator cover pivotally mounted on one plate for urging and engaging one plate toward and with the other plate.

3. The hanger of claim 2, wherein each of said plates has teeth, said teeth of one of said plates opposed and complementary to said teeth of said other plate to grip the material placed between said plates.

4. A textile or the like hanger, comprising:

at least two releasably fastenable suspender clips, an elongate support rod, and at least two support brackets for attaching said rod to and spaced apart from a vertical surface or wall;

each of said clips slidably suspendable from said elongate support rod so that, in use, said clips simultaneously hold a textile or the like material in a vertical plane;

each of said clips including a gripper and a hook, said hook slidably hangable about said rod permitting said clips to be disposed at any position along said rod, wherein said hook includes a cradle-like portion and a neck portion, and wherein said neck portion is press-fittedly connected in said gripper.

5. An apparatus for displaying textile articles comprising (i) a rod, (ii) a plurality of support brackets fastenable to a vertical display surface for holding said rod horizontally, and (iii) a plurality of toothed suspender clips slidably suspendable from said rod for securing the textile articles to said rod, wherein each of said clips comprises a first and a second toothed plate, a cradle hook, and a manual actuator;

said first and second toothed plates having tongue-and-groove means for interconnecting said plates;

said cradle hook including a wire form having a hook portion and a neck portion; said neck portion operatively secured to one of said plates;

said manual actuator interengaging said first and second toothed plates to form a normally-closed mouth for gripping the textile articles.

6. An apparatus for displaying textile articles comprising (i) a rod, (ii) a plurality of support brackets fastenable to a vertical display surface for holding said rod horizontally, and (iii) a plurality of toothed suspender clips slidably suspendable from said rod for securing the textile articles to said rod, wherein said support brackets include end brackets and one or more intermediate brackets, wherein said intermediate brackets have an aperture for passing said rod therethrough and a screw for engaging said rod to hold firmly said rod in said bracket.

7. A method for displaying a textile item comprising the steps of: (i) fixedly securing a horizontal rod parallel to a vertical display surface, (ii) slidably suspending a plurality of manually-actuated, toothed suspender clips from said rod, each of said clips including a gripper and a hook, said hook having a first end having a cradle-like portion contoured to said rod and slidably hangable about said rod permitting said clips to be disposed at any position along said rod, said hook further having a second end having a neck portion opposite said first end, with said neck portion operatively secured to said gripper, (iii) gripping one edge of a textile item into said suspender clips, and (iv) manually actuating said suspender clips to secure the textile item to said rod whereby said textile item is held in a vertical orientation and parallel to said vertical display surface.

8. The method of claim 7, wherein said suspending clips include hanging each clip into said rod by said hook.

9. A carpet display kit, comprising:

a rod;

two or more support brackets for fixedly holding said rod;

a plurality of toothed suspender clips, wherein each of said clips comprises a first and second toothed plate, a cradle hook, and a manual actuator; said first and second toothed plates having tongue-and-groove means for interconnecting said plates; said cradle hook including a wire form having a hook portion and a neck portion; said hook portion for hanging said clips on said rod; said neck portion operatively secured to one of said plates; said manual actuator interengaging said first and second toothed plates to form a normally-closed mouth for gripping a carpet; and fasteners for securing said support brackets to a vertical surface wherein said rod is fixedly secured; oriented horizontally and wherein said carpet is held in a vertical orientation and parallel to said vertical support surface.

* * * * *